US009308150B2

(12) United States Patent
Kubo et al.

(10) Patent No.: US 9,308,150 B2
(45) Date of Patent: Apr. 12, 2016

(54) LIQUID AGENT CONTAINER

(75) Inventors: Tomohiko Kubo, Osaka (JP); Kazuya Kishimoto, Osaka (JP)

(73) Assignees: NIPRO CORPORATION, Osaka-Shi (JP); WAKAMOTO PHARMACEUTICAL CO., LTD., Tokyo (JP)

( * ) Notice: Subject to any disclaimer, the term of this patent is extended or adjusted under 35 U.S.C. 154(b) by 630 days.

(21) Appl. No.: 12/516,322

(22) PCT Filed: Nov. 13, 2007

(86) PCT No.: PCT/JP2007/071982

§ 371 (c)(1),
(2), (4) Date: May 26, 2009

(87) PCT Pub. No.: WO2008/065879

PCT Pub. Date: Jun. 5, 2008

(65) Prior Publication Data

US 2010/0084397 A1 Apr. 8, 2010

(30) Foreign Application Priority Data

Nov. 27, 2006 (JP) ..... 2006-318718

(51) Int. Cl.
*B65D 51/18* (2006.01)
*A61J 1/14* (2006.01)
(Continued)

(52) U.S. Cl.
CPC ..... *A61J 1/1412* (2013.01); *B65D 47/18* (2013.01); *B65D 51/1633* (2013.01); *A61J 1/145* (2015.05); *A61J 1/1418* (2015.05); *A61J 1/1456* (2015.05);
(Continued)

(58) Field of Classification Search
CPC .... A61J 1/1412; B65D 51/1633; B65D 47/18
USPC ..... 222/189.08; 220/203.02, 203.11, 220/203.18
See application file for complete search history.

(56) References Cited

U.S. PATENT DOCUMENTS

| | | | | |
|---|---|---|---|---|
| 4,513,891 | A | 4/1985 | Hain et al. | |
| 4,736,083 | A * | 4/1988 | Saville | 219/686 |
| 5,240,149 | A * | 8/1993 | Schmidt | 222/212 |

(Continued)

FOREIGN PATENT DOCUMENTS

| | | | |
|---|---|---|---|
| JP | 62-127063 | A | 6/1987 |
| JP | 2004-166978 | A | 6/2004 |
| WO | WO-02/070353 | A2 | 9/2002 |

*Primary Examiner* — Fenn Mathew
*Assistant Examiner* — Elizabeth Volz
(74) *Attorney, Agent, or Firm* — Birch, Stewart, Kolasch & Birch, LLP

(57) ABSTRACT

A liquid agent container includes the container's main unit, a cap, an intermediate member, and an internal stopper. The cap is provided with a liquid agent discharging path and an air introducing path. The intermediate member has a tube projecting toward the interior of the main unit. Between a liquid agent introducing path and the liquid agent discharging path a hydrophilic filter is provided, and between an air supplying path communicating with the air introducing path and an air delivering path a filter is provided. The air delivering path communicates with the interior of the main unit via a check valve, with an annular valve having an inner circumferential surface in contact with an outer circumferential surface of the tube, to pass air only in a direction toward the interior of the main unit. The present invention can provide a liquid agent container including a check valve readily fabricated and ensuring preventing a liquid agent from flowing back.

8 Claims, 7 Drawing Sheets

(51) Int. Cl.
*B65D 47/18* (2006.01)
*B65D 51/16* (2006.01)

(52) U.S. Cl.
CPC ..... *A61J 1/1468* (2015.05); *A61J 1/2075* (2015.05); *A61J 1/2082* (2015.05); *A61J 1/2086* (2015.05)

(56) References Cited

U.S. PATENT DOCUMENTS 5,320,254 A * 6/1994 Ranalletta et al. ..... 222/189.08
5,490,938 A * 2/1996 Sawan et al. ..... 210/651
5,588,559 A * 12/1996 Vallet Mas et al. ..... 222/92
5,727,715 A * 3/1998 McKenna et al. ..... 222/189.09
5,988,448 A * 11/1999 Foth ..... 222/189.09
6,273,305 B1 * 8/2001 Fioravanti et al. ..... 222/494
6,631,823 B2 * 10/2003 Stillinger et al. ..... 220/714
6,874,656 B2 * 4/2005 Rohr et al. ..... 222/1
7,077,176 B2 * 7/2006 Py ..... 141/301
7,172,099 B2 * 2/2007 Hofte et al. ..... 222/481.5
7,568,509 B2 * 8/2009 Py ..... 141/301
2002/0130139 A1 * 9/2002 Shiraishi et al. ..... 222/105
2002/0153386 A1 * 10/2002 Uetake et al. ..... 222/1
2002/0166864 A1 * 11/2002 Stillinger et al. ..... 220/714
2005/0139611 A1 * 6/2005 Kubo et al. ..... 222/189.06
2005/0254882 A1 * 11/2005 Hofte et al. ..... 401/140
2010/0084397 A1 * 4/2010 Kubo et al. ..... 220/256.1

* cited by examiner (a)

(b)

(c)

LIQUID AGENT CONTAINER

BACKGROUND OF THE INVENTION

1. Field of the Invention

The present invention relates to liquid agent containers. More specifically, the present invention relates to liquid agent containers used to store liquid agents, cosmetics and the like, that can prevent liquid agents in the containers from being contaminated by bacteria, microorganism and the like.

2. Description of the Related Art

Generally, liquid agent containers used to store liquid agents, cosmetics and the like therein do not have their interiors aseptically insulated from outside. Once the container has been opened and used, it has its internal liquid agent constantly in communication with the atmosphere through a nozzle hole. Thus there is a possibility that airborne bacteria may enter the interior of the container through the nozzle hole. Furthermore, if in use the nozzle contacts the user's skin, bacteria, microorganism, and the like that adhere to the user's skin may readily enter the interior of the container through the nozzle hole.

Furthermore, liquid agent containers are implemented generally as containers pressed with hands/fingers to discharge their internal liquid agents and recovering their original forms in geometry when they are liberated from being pressed. When the containers deformed as they are pressed recover their original forms in geometry, the containers aspirate the air therein. When conventional liquid agent containers thus aspirate the air therein, there is a possibility that they may also aspirate airborne bacteria, microorganism and the like therein, and once bacteria, microorganism and the like have entered the liquid agent containers, there is a possibility that the bacteria, microorganism and the like may use as nutrients effective components contained in the liquid agents or a buffering agent, a solubilization agent and the like added to stabilize the liquid agents, and may thus increases in the containers.

A container having a nozzle internally provided with a hydrophilic filter has been proposed to prevent bacteria, microorganism and the like from entering the container after use when a liquid agent remaining in the nozzle flows back into the interior of the container or the container pressed and thus elastically deformed recovers its original form in geometry. The hydrophilic filter, however, has in a general condition a nature allowing liquid to pass therethrough and preventing gas from passing therethrough, and the container after its internal liquid is reduced would remain deformed as it has been pressed.

Accordingly there has been proposed a container provided with a nozzle hole and in addition thereto an air vent hole. Patent Document 1 (Japanese Patent Laying-open No. 2004-166978) proposes a liquid agent container provided with a hydrophilic filter between a nozzle and an interior of a main unit of the container and a hydrophobic filter at an air vent path that introduces air into the interior of the main unit of the container to prevent bacteria, microorganism and the like from entering the container after use when a liquid agent remaining in the nozzle flows back into the interior of the container or the container pressed and thus elastically deformed recovers its original form in geometry.

The liquid agent container described in Patent Document 1, as shown in FIG. 7, has a cap 102 having an inner side provided with a filter attachment member 103 having one surface provided with a hydrophobic filter 105 and the other surface provided with a hydrophilic filter 104. Furthermore, between hydrophobic filter 105 and the interior of the container, a flow rate limiter unit is provided. The flow rate limiter unit is configured of a check valve 141 or an orifice.

According to Patent Document 1, when the liquid agent container has a liquid agent flowing from the nozzle back into the interior of the container, hydrophilic filter 104 prevents bacteria, microorganism and the like from entering. Furthermore, when the container's main unit 101 receives air flowing thereinto, hydrophobic filter 105 prevents bacteria, microorganism and the like from entering. In addition, between hydrophobic filter 105 and the interior of main unit 101 of the container, a flow rate limiter unit implemented as check valve 141 or an orifice is provided. This allows the container to internally maintain negative pressure for a period of time sufficient to recover the liquid agent that remains in the nozzle through the hydrophilic filter into the interior of the container. Patent Document 1: Japanese Patent Laying-open No. 2004-166978

SUMMARY OF THE INVENTION

Problems to be Solved by the Invention

The liquid agent container described in Patent Document 1 employs check valve 141 of a duckbill type. This check valve 141 requires forming mutually adjacent, paired valve bodies in the form of a wedge, and subsequently cutting the valve bodies at their adjacent portions with a cutter, as shown in FIG. 8. Operating the check valve at a predetermined pressure precisely, requires cutting with high precision.

The valve body is configured of rubber, elastomer, and/or the like. It readily deforms, and is thus difficult to precisely cut. As such, production error is inevitable, resulting in unstable production performance.

Furthermore, the liquid agent container described in Patent Document 1 that has the flow rate limiter unit configured of an orifice has its internal liquid flowing back to and thus impairing hydrophobic filter 105 in performance.

In addition, the liquid agent container described in Patent Document 1 requires welding a hydrophobic filter to the filter attachment member at one surface, welding a hydrophilic filter to the filter attachment member at the other surface, and furthermore, cutting. In other words, three steps are required in different directions to produce a single component.

It is not easy to handle a small component of an internal structure of a liquid agent container in performing the three steps while changing the component in orientation. Furthermore, if a defect is caused in any of the three steps, it directly leads to a defective product, and in addition, a defect in the final step results in the preceding steps all in vain and thus has a significant effect.

The present invention has been made to overcome the above disadvantages, and it contemplates a liquid agent container preventing bacteria and the like from entering the same, that includes a check valve that can be readily fabricated and ensures preventing a liquid agent from flowing back.

Means for Solving the Problems

In accordance with the present invention a liquid agent container includes: a main unit having a mouth, and deformable by a pressure exerted to press the main unit, and recovering an original form in geometry when the main unit is liberated from the pressure; a cap provided with a liquid agent discharging path for discharging a liquid agent and an air introducing path for introducing air, and attached to the main unit at the mouth; a hydrophilic filter; an intermediate member having a tube projecting toward an interior of the main unit, the intermediate member being provided with a liquid agent introducing path provided internal to the tube and communicating with the liquid agent discharging path via the hydrophilic filter, and an air supplying path communicating with the air introducing path, the intermediate member being located at an internal side of the cap; a filter; and an internal stopper having an annular valve configuring a check valve having an inner circumferential surface in contact with an outer circumferential surface of the tube and passing air only in a direction toward the interior of the main unit, the internal stopper being provided with an air delivering path communicating with the air supplying path via the filter and communicating with the interior of the main unit via the check valve, the internal stopper being located at an internal side of the intermediate member.

In the liquid agent container, the check valve may remove a hermetically sealed state, in response to the main unit having an internal pressure lower than an atmospheric pressure with a difference of at least 5 KPa, to pass air proceeding through the air delivering path toward the interior of the main unit.

In the liquid agent container, the internal stopper may have an outer circumferential portion sandwiched between an end surface of the mouth of the main unit and the intermediate member.

In the liquid agent container, the hydrophilic filter provided between the liquid agent discharging path and the liquid agent introducing path may be attached to the cap and the filter provided between the air supplying path and the air delivering path may be attached to the intermediate member.

In the liquid agent container, the filter provided between the air supplying path and the air delivering path may be a hydrophobic filter.

In the liquid agent container, the internal stopper may be provided with a fit hole located coaxially with the check valve and receiving the tube to fit the tube therein.

In the liquid agent container, an air vent groove extending in a direction in which the tube passes through may be provided between an internal surface of the fit hole and an external surface of the tube.

Effects of the Invention

The present invention can provide a liquid agent container including a check valve readily fabricated and ensuring preventing a liquid agent from flowing back.

DESCRIPTION OF THE REFERENCE SIGNS

1: main unit of container, 2: cap, 3: intermediate member, 4: internal stopper, 6: nozzle cap, 11: the main unit's body, 12: mouth, 13: engaging projection, 21: top, 21*a*: rib, 21*b*: diaphragm, 22: skirt, 23: groove to be engaged, 24: nozzle, 25: liquid agent discharging path, 27: external thread, 28: air introducing path, 29: hydrophilic filter, 31: body of intermediate member, 31*a*: rib, 31*b*: diaphragm, 32: projection, 34: liquid agent introducing path, 35: tube, 35*a*: air vent groove, 36: air supplying path, 37: hydrophobic filter, 42: annular valve, 43: air delivering path, 44: fit hole, 45: flange, 61: seal, 62: internal thread.

DETAILED DESCRIPTION OF THE INVENTION

Hereinafter, reference will be made to the drawings to describe a structure of a liquid agent container in an embodiment based on the present invention.

Figure 1:
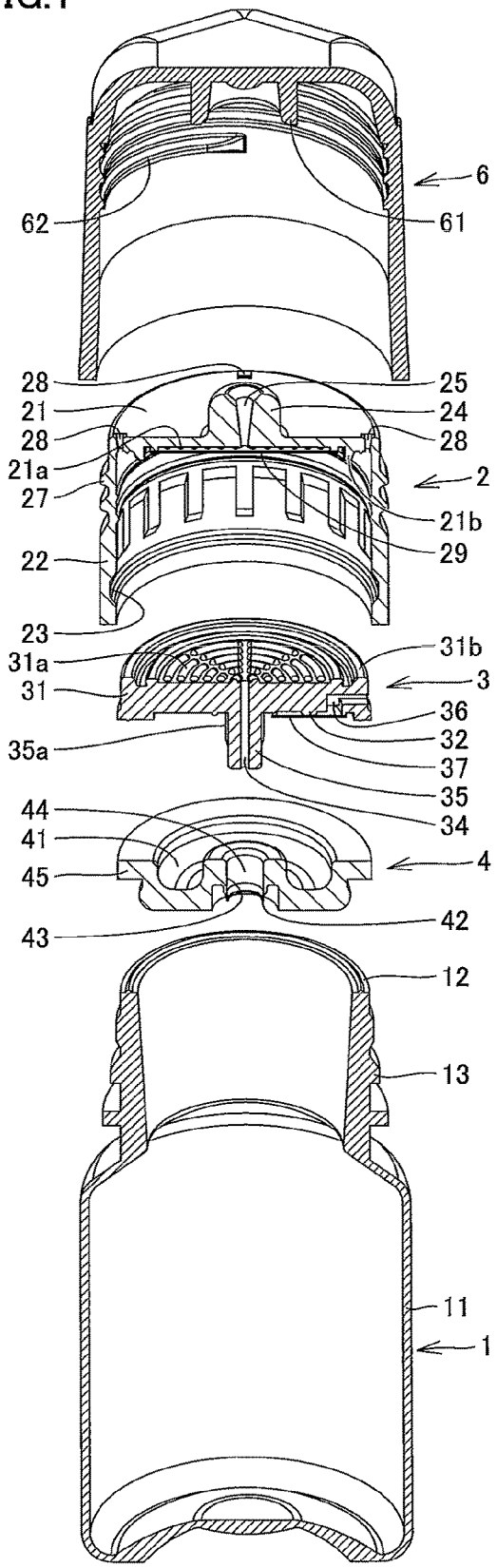
FIG. 1 is an exploded perspective view of a liquid agent container in an embodiment of the present invention.
Figure 2:
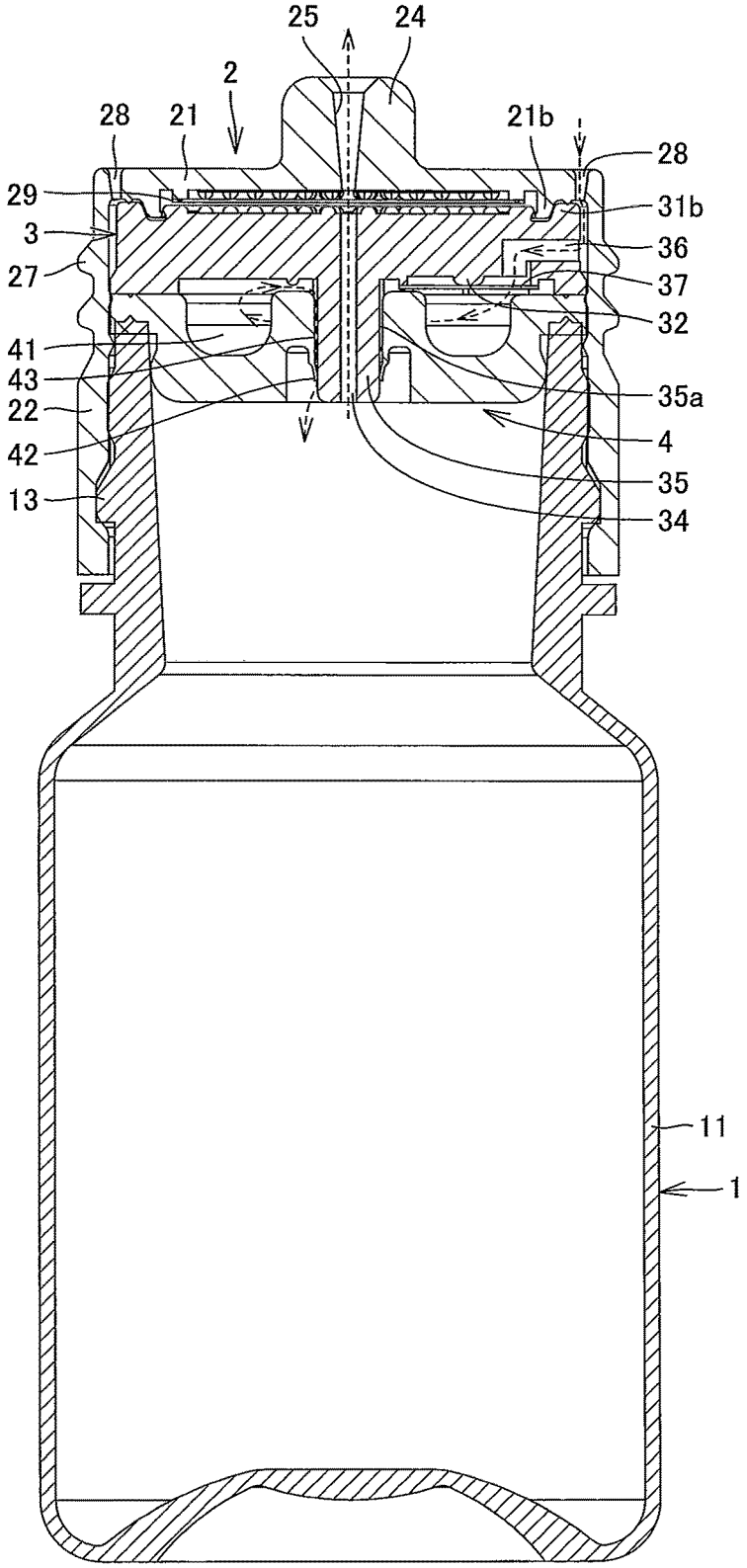
FIG. 2 is a longitudinal cross section of the liquid agent container in the embodiment of the present invention.

FIG. 1 is an exploded perspective view of a liquid agent container in the present embodiment and FIG. 2 is a longitudinal cross section thereof. As shown in FIG. 1 and FIG. 2, the present embodiment provides a liquid agent container including the container's main unit 1, a cap 2, an intermediate member 3, and an internal stopper 4. The container's main unit 1 has a mouth 12. The container's main unit 1 is deformable by a pressure exerted to press it, and recovers its original form in geometry when it is liberated from the pressure. Cap 2 is provided with a liquid agent discharging path 25 for discharging a liquid agent and an air introducing path 28 for introducing air. Cap 2 is attached to the container's main unit 1 at mouth 12. Intermediate member 3 has a tube 35 projecting toward the interior of the container's main unit 1. Intermediate member 3 is provided with a liquid agent introducing path 34 provided internal to tube 35 and communicating with liquid agent discharging path 25 via a hydrophilic filter 29, and an air supplying path 36 communicating with air introducing path 28. Intermediate member 3 is located at an internal side of cap 2. Internal stopper 4 has an annular valve 42 configuring a check valve having an inner circumferential surface in contact with an outer circumferential surface of tube 35 and passing air only in a direction toward the interior of the container's main unit 1. Internal stopper 4 is provided with an air delivering path 43 communicating with air supplying path 36 via hydrophobic filter 37 and communicating with the interior of the container's main unit 1 via the check valve. Internal stopper 4 is located at an internal side of intermediate member 3. Hereinafter, these structures will each be described more specifically.

The container's main unit 1 can adopt any geometrical form, such as a bottomed cylinder, as shown in FIG. 1, or a form with a side wall having a lower end closed. The container's main unit 1 has an upper end with a mouth 12 smaller in diameter than the main unit's body 11. Mouth 12 has an outer circumferential surface having an engaging projection 13 for fitting cap 2 thereon. Engaging projection 13 is provided to run around an outer circumference of the upper end of the container's main unit 1. Mouth 12 has an end surface provided with a circular rib to enhance mouth 12 in watertightness. The rib after it is assembled digs into internal stopper 4 to enhance mouth 12 in watertightness.

The container's main unit 1 is formed of a flexible material that is deformable by a pressure exerted with hands/fingers to press it and can also readily recover its original form in geometry when it is liberated from such pressure. Such flexible material for example includes polypropylene, polyethylene, polyethylene terephthalate, polyethylene terenaphthalate, polyester, soft polyvinyl chloride, thermoplastic elastomer, polycarbonate, or other similar, various types of elastic macromolecular materials.

Cap 2 is a member formed in a cylinder having an open lower end. Cap 2 is formed of a circular top 21 and a skirt 22 extending from a circumferential edge of top 21. Skirt 22 has an inner circumferential surface having a groove 23 engaged with engaging projection 13 of the container's main unit 1.

Top 21 has a center having a nozzle 24 projecting upward. Nozzle 24 is formed in a cylinder or a truncated cone. Nozzle 24 is internally provided with a liquid agent discharging path 25 by a nozzle hole penetrating along a major axis. Liquid agent discharging path 25 has an inner diameter increased toward a tip of nozzle 24. Furthermore, cap 2 has an outer circumferential surface having an external thread 27.

Top 21 of cap 2 is provided with air introducing path 28 penetrating top 21 vertically. In the present embodiment air introducing path 28 is provided to cap 2 at top 21 at four locations along an outer circumferential portion at equal intervals. While more than one air introducing path 28 is preferable, only one air introducing path 28 may be provided.

Top 21 of cap 2 has a lower surface provided with hydrophilic filter 29 with an outer circumferential portion thereof welded. Hydrophilic filter 29 is configured in a circle.

Figure 3:
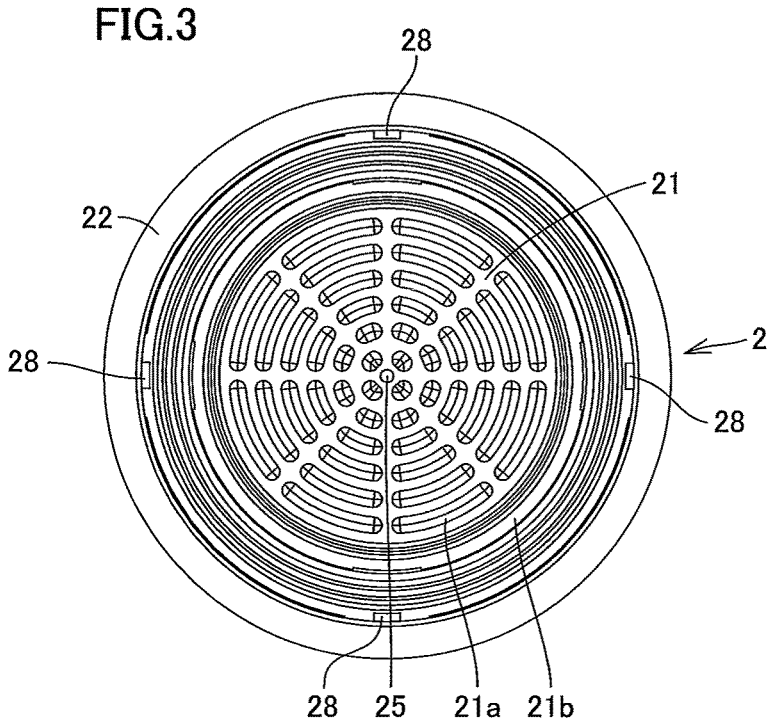
FIG. 3 is a lower side view of a cap in structure in the embodiment of the present invention with a hydrophilic filter removed.

FIG. 3 is a lower side view of the cap with the hydrophilic filter removed. A portion that hydrophilic filter 29 contacts is provided with a large number of concentrically arranged ribs 21*a*. Rib 21*a* at a portion traversing a line extending radially from its center is provided with an interrupted portion. The interrupted portion is not provided with rib 21*a*.

Rib 21*a* serves to prevent hydrophilic filter 29 and a lower surface of top 21 from completely intimately contacting each other and also ensure a channel. More specifically, the interrupted portion and a gap between ribs 21*a* serve as a channel to ensure a flow to an entire surface of hydrophilic filter 29.

Air introducing path 28 is configured in a rectangle as seen in a plane. Furthermore, it is configured, as seen in cross section, to have an area in cross section tapered downward. Air introducing path 28 and hydrophilic filter 29 are insulated therebetween by an annular, downwardly projecting diaphragm 21*b*.

Figure 4:
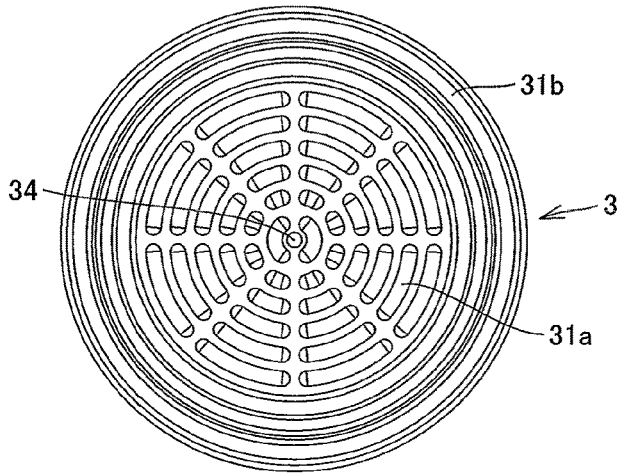
FIGS. 4(*a*), 4(*b*), 4(*c*) are plan, side and bottom views, respectively, of an intermediate member in structure in the embodiment of the present invention.
Figure 4:
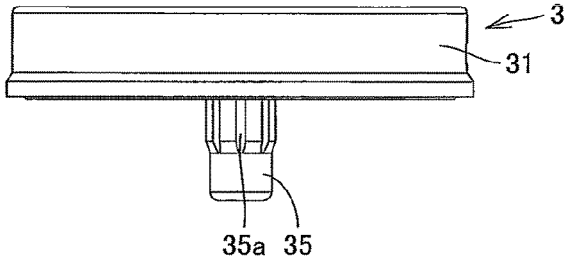
Figure 4:
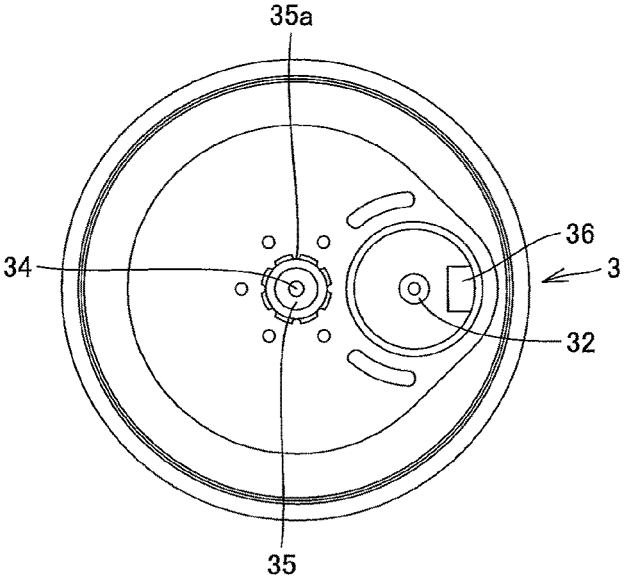

FIGS. 4(*a*), 4(*b*), 4(*c*) show the intermediate member in structure in plan, side and bottom views, respectively. Intermediate member 3 has a main body 31 generally in the form of a disk, and tube 35 located at a lower surface thereof and projecting downward. Intermediate member 3 has a center provided with liquid agent introducing path 34 penetrating it vertically. Liquid agent introducing path 34 and liquid agent discharging path 25 provided to cap 2 are located on a single straight line.

As shown in FIG. 1 and FIG. 4(*a*), the intermediate member's main body 31 at an upper surface opposite to hydrophilic filter 29 is provided with a large number of concentrically arranged ribs 31*a*. Rib 31*a* at a portion traversing a line extending radially from its center is provided with an interrupted portion. The interrupted portion is not provided with rib 31*a*.

As well as rib 21*a*, rib 31*a* also serves to ensure a flow path to an entire surface of hydrophilic filter 29. A diaphragm 31*b* is provided to surround the portion provided with rib 31*a*. As shown in FIG. 2, diaphragm 31*b* intimately contacts cap 2 at diaphragm 21*b* to serve as a partition between air introducing path 28, and liquid agent discharging path 25 and liquid agent introducing path 34 provided with hydrophilic filter 29.

Intermediate member 3 has an outer circumferential surface having a lower end larger in diameter than an upper portion and an intermediate portion. The outer circumferential upper and intermediate portions of intermediate member 3 and the inner circumferential surface of cap 2 form a gap, which defines a portion of air supplying path 36, as shown in FIG. 2. The intermediate member's main body 31 has a main path of air supplying path 36 formed therein by an air path opened at an outer circumferential surface of intermediate member 3, extending horizontally, and then bent downward.

The air path that configures air supplying path 36 has a downstream end opened at a location, which is provided with hydrophobic filter 37. Hydrophobic filter 37 may be replaced with a hydrophilic filter.

Hydrophobic filter 37 is configured in a circle and has an outer circumference welded to a lower surface of intermediate member 3. While FIG. 4(*c*) shows a lower side of the intermediate member with the hydrophobic filter removed, a location at which hydrophobic filter 37 is provided has at a center a projection 32 preventing hydrophobic filter 37 from intimately contacting intermediate member 3. Hydrophobic filter 37 is disposed at a position offset from the center of intermediate member 3.

Tube 35 has a lower portion formed in a column. Tube 35 has an intermediate portion and an upper portion larger in diameter than the lower portion, and furthermore, provided with a longitudinally extending air vent groove 35*a*. Tube 35 has the lower portion intimately contacting an inner circumferential surface of annular valve 42 and air vent groove 35*a* configures air delivering path 43.

Cap 2 and intermediate member 3 can be formed with synthetic resin. Cap 2 can be formed with polypropylene, polyethylene, polyethylene terephthalate, polycarbonate or the like. Intermediate member 3 is required to have resilience and elasticity to some extent, and can be formed for example with random polypropylene, polyethylene, elastomer, vinyl chloride, or the like. The present embodiment provides cap 2 configured of polypropylene and intermediate member 3 configured of polyethylene.

Internal stopper 4 is configured of rubber, elastomer or a similar material rich in elasticity. Herein, it is configured of styrene based elastomer. The material configuring internal stopper 4 for example includes thermoplastic elastomer, polyolefin resin (low-density polyethylene, random polypropylene), and the like. Internal stopper 4 has an upper surface provided with a circularly extending recess 41. Recess 41 is partially opposite to hydrophobic filter 37. Recess 41 serves as a channel for air flowing in through hydrophobic filter 37.

Internal stopper 4 has a center provided with a fit hole 44 penetrated by tube 35 longitudinally. Fit hole 44 has a lower end provided with annular valve 42. Annular valve 42 is an annular member downwardly tapered in thickness, as shown in FIG. 1 and FIG. 2, and has a lower end, inner circumferential surface intimately contacting an outer circumference of tube 35 to configure a check valve.

Internal stopper 4 has an upper end having a flange 45 having an outer circumferential portion projecting outward. Flange 45 has a lower surface intimately contacting an end surface of mouth 12 of the container's main unit 1. When it is assembled, internal stopper 4 has outer circumferential flange 45 sandwiched between an end surface of mouth 12 of the container's main unit 1 and intermediate member 3. The elasticity of internal stopper 4 allows cap 2 and intermediate member 3, intermediate member 3 and internal stopper 4, and internal stopper 4 and the container's main unit 1 to intimately contact each other to maintain airtightness.

To close the tip of nozzle 24, a nozzle cap 6 is provided, as shown in FIG. 1. Nozzle cap 6 is a generally cylindrical member with an opened bottom, and has a ceiling surface provided with a seal 61 intimately contacting the tip of nozzle 24 to hermetically seal the nozzle hole.

Seal 61 is formed in a cylinder with a lower portion opened. Nozzle cap 6 has an inner circumferential surface provided with an internal thread 62. Nozzle cap 6 is secured by screwing together internal thread 62 and external thread 27 provided at the outer circumferential surface of cap 2. Nozzle cap 6 seals both nozzle 24 and air introducing path 28.

Figure 5:
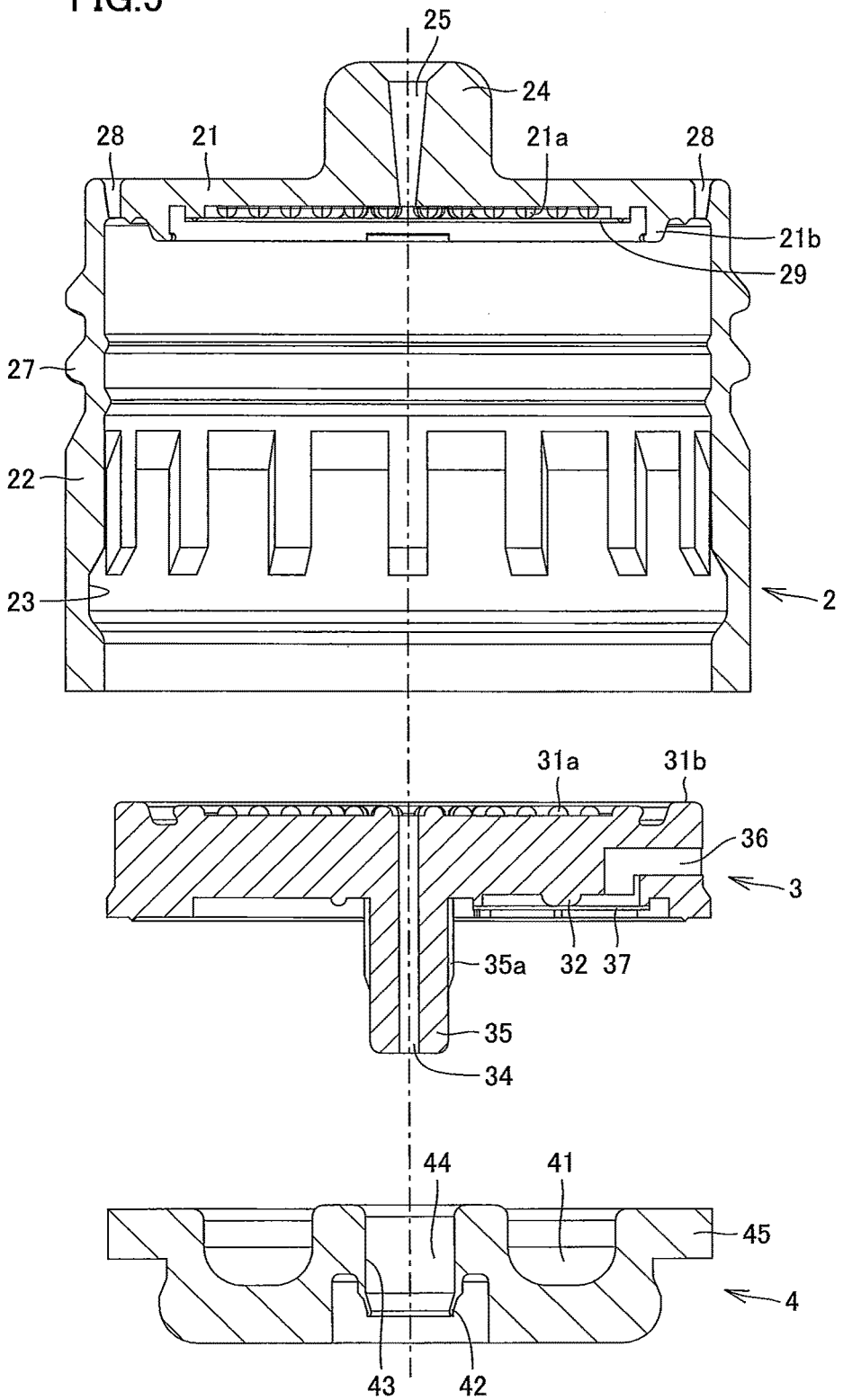
FIG. 5 is an exploded cross section of the cap, the intermediate member and an internal stopper in structure in the embodiment of the present invention.
Figure 6:
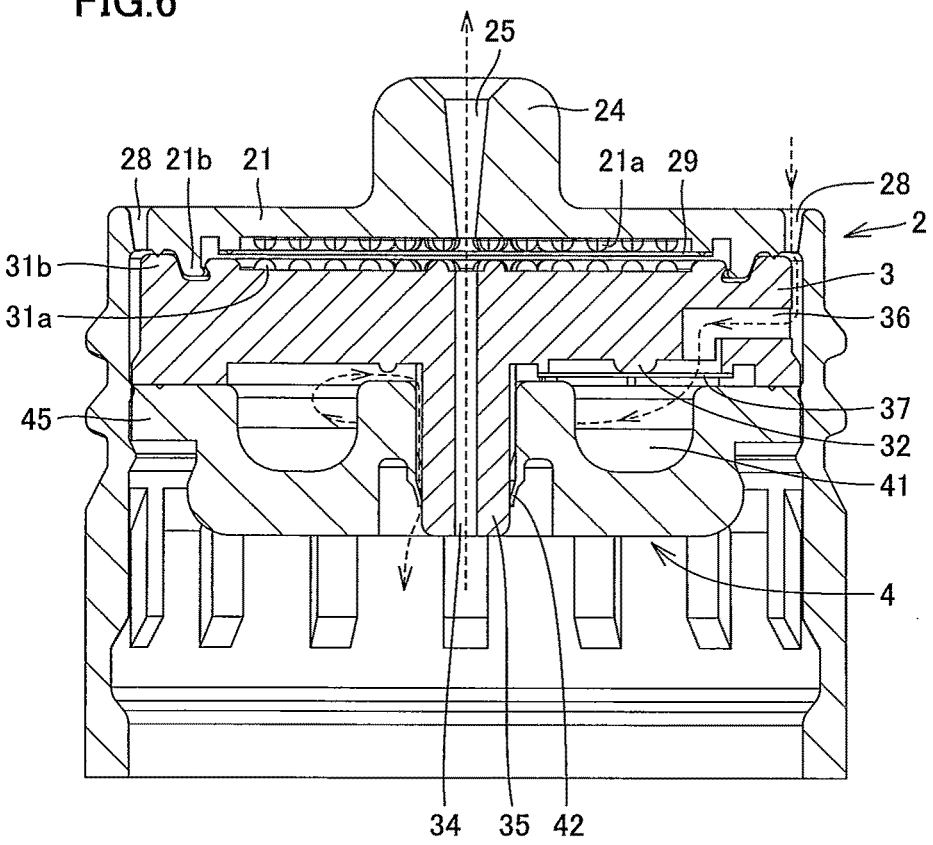
FIG. 6 is a cross section of the cap, intermediate member and internal stopper in the embodiment of the present invention, as assembled together.
Figure 7:
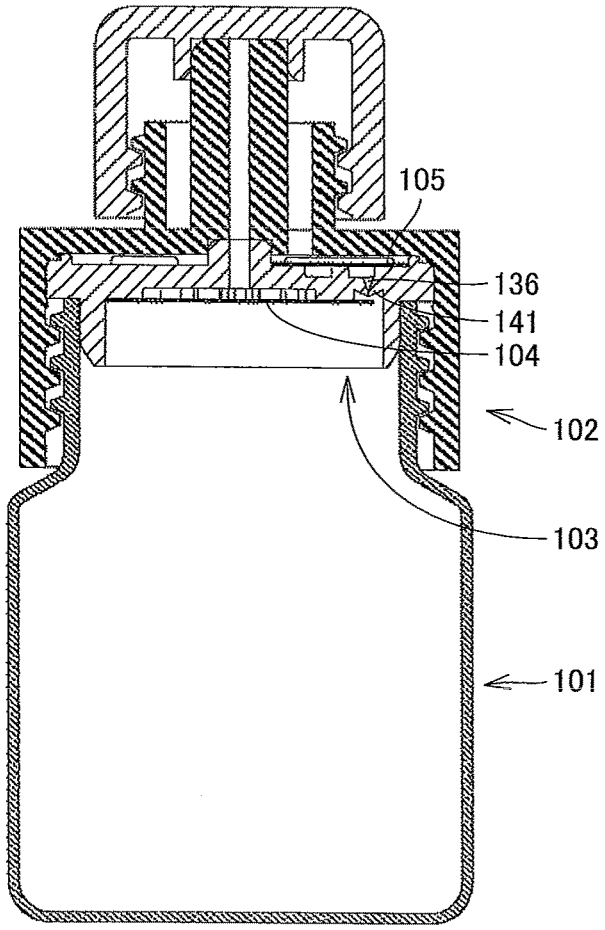
FIG.7 PRIOR ART
FIG. 7 is a longitudinal cross section of a liquid agent container in structure, as conventional.
Figure 8:
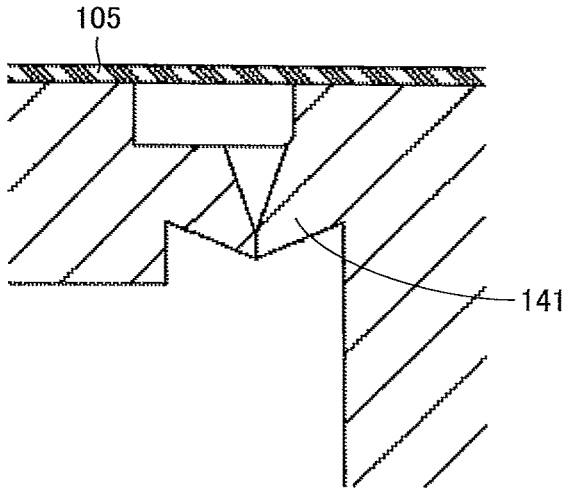
FIG.8 PRIOR ART
FIG. 8 is a longitudinal cross section of a check valve of a liquid agent container in structure, as conventional.

FIG. 5 is an exploded cross section of the cap, intermediate member and internal stopper in structure and FIG. 6 is a cross section of the cap, intermediate member and internal stopper assembled together. When the liquid agent container of the present embodiment is assembled, intermediate member 3 and internal stopper 4 are inserted into cap 2. Subsequently, the container's main unit 1 has mouth 12 inserted into cap 2 to cause cap 2, intermediate member 3, internal stopper 4 and mouth 12 to mutually contact intimately.

At the time, intermediate member 3 has tube 35 passing through fit hole 44 of internal stopper 4. As has been described previously, tube 35 has its upper and intermediate portions larger in diameter than its lower portion. Tube 35 has the radially larger portion fitted into fit hole 44 of internal stopper 4. Tube 35 is thus positioned in internal stopper 4 at a predetermined position. Simultaneously, tube 35 has its tip's radially smaller portion intimately contacting an inner circumferential surface of annular valve 42 of internal stopper 4 to configure the check valve. At the time, tube 35 and internal stopper 4 have been positioned precisely. This ensures that tube 35 is positioned at a predetermined position relative to annular valve 42, and hence that a check valve having a desired performance is obtained.

Furthermore, the check valve can be configured simply by passing tube 35 through annular valve 42. A check valve can thus be configured that dispenses with a cutting, as a conventional check valve requires, and readily and reliably operates.

In the present embodiment the check valve is configured such that when the container's main unit 1 has an internal pressure lower than the atmospheric pressure by 5 KPa or larger, annular valve 42 opens outward to form a gap between annular valve 42 and tube 35 to remove a hermetically sealed state to pass air proceeding through air delivering path 43 toward the interior of the container's main unit 1. This is based on that the container's main unit 1 pressed with fingers and thus deformed recovers its original form in geometry with a force, which generates a negative pressure of 5 KPa to 30 KPa in the interior of the container's main unit 1.

Essentially, the check valve may be any such valve that when the container's main unit 1 has even a smallest negative pressure therein the valve introduces air received through air delivering path 43 and prevents a flow back to air delivering path 43. In view of ensuring that back flow is prevented, and in view of the check valve serving as a flow rate limiter member, a check valve is preferably used that opens for a negative pressure slightly smaller than that caused by the container's main unit 1. If the container recovering from a deformed state to its original form in geometry causes a large negative pressure in the interior of the container's main unit 1, the check valve may be adapted to open for an increased pressure. The pressure can be set at a variety of values by changing the annular valve in material, geometry, and the like.

A method of employing the liquid agent container in the present embodiment will be described hereinafter. Initially, for use, nozzle cap 6 is removed. Then, the container's main unit 1 is pressed with hands/fingers to discharge a liquid agent contained therein. The contained liquid agent is pushed out of the interior of the container, passes through liquid agent introducing path 34, hydrophilic filter 29 and liquid agent discharging path 25, and drops externally through nozzle 24.

At the time, the check valve configured of annular valve 42 and tube 35 is closed, and the liquid agent will not enter air delivering path 43. As such, the liquid agent also will not contact hydrophobic filter 37. As such, if the liquid agent is bad in chemistry with the material(s) of hydrophobic filter 37, hydrophobic filter 37 can be prevented from degradation (e.g., having hydrophilic property), and hydrophobic filter 37 can be prevented from having a lower surface with the liquid agent precipitated thereon.

The liquid agent is dropped by a required amount and thereafter when pressing the container's main unit 1 is ceased, the container's main unit 1 swells, as based on its flexibility, to recover its original form in geometry. At the time, the container's main unit 1 has negative pressure therein. By this negative pressure, the liquid agent that is retained in the nozzle hole after discharging the liquid agent is stopped will be passed through hydrophilic filter 29 and thus returned to the container's main unit 1.

The liquid agent retained in the nozzle hole returns through hydrophilic filter 29 to the interior of the container's main unit 1. If the liquid agent retained in the nozzle hole has bacteria or the like mixed therein, the bacteria are filtered off by hydrophilic filter 29.

On the other hand, the container's main unit 1 has negative pressure therein, and the check valve slightly opens. Thus, the container's main unit 1 receives air flowing thereinto through air introducing path 28, air supplying path 36, hydrophobic filter 37 and air delivering path 43. At the time, the check valve limits the introduced air in flow rate. Accordingly, the introduced air enters the interior of the container's main unit 1 gradually, and accordingly, the container's main unit 1 also recovers its original form in geometry slowly over time. In other words, the liquid agent on hydrophilic filter 29 can be recovered into the container's main unit 1 over a sufficient period of time.

The liquid agent is thus passed by the negative pressure internal to the container's main unit 1 through hydrophilic filter 29 over a sufficient period of time, and nozzle 24 can be prevented from having the liquid agent retained therein. When nozzle 24 has the liquid agent retained therein for a long period of time, bacteria and the like increases in that retained liquid agent, and when the liquid agent is subsequently used, the bacteria and the like can be mixed in the liquid agent. The liquid agent container in the present embodiment can prevent such disadvantage.

Furthermore, the container's main unit 1 can receive air flowing thereinto that has passed through hydrophobic filter 37 and thus had bacteria, microorganism and the like filtered off. The container's main unit 1 can thus have its interior maintained aseptically.

Such hydrophilic and hydrophobic filters have holes having a diameter preferably of 0.45 μm or less, more preferably 0.22 μm or less in order to prevent *Candida albicans*, the *Pseudomonas* genus, *Burkholderia cepacia* and the like generally known as contamination-causing bacteria from entering the interior of the container.

Furthermore, the filter's capturing mechanism is generally categorized into two types, i.e., a "depth type" capturing bacteria and the like in the filter and a "screen type" capturing bacteria and the like at a surface of the filter. Any of the types can suitably be used in the present invention.

The liquid agent container in the present embodiment includes cap 2 having hydrophilic filter 29 attached thereto, and intermediate member 3 having hydrophobic filter 37 attached thereto. The two filters are not attached to a single member. Rather, they are attached to different members, respectively. In fabricating a conventional liquid agent container, hydrophobic and hydrophilic filters are attached to a single member at opposite surfaces, which requires inverting the member. The present liquid agent container can dispense with inverting the member and thus facilitate attaching the filters.

The present liquid agent container is remarkably effective when it is used as a container for a chemical agent required to be more aseptic than cosmetics, inter alia, an instillation container that is used to store instillation having a preservative added in a limited amount.

It should be understood that the embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

INDUSTRIAL APPLICABILITY

The present invention can thus provide a liquid agent container including a check valve that can be readily fabricated and ensures preventing a liquid agent from flowing back.

The invention claimed is:

1. A liquid agent container comprising:

a main unit having a mouth, and deformable by a pressure exerted to press said main unit, and recovering an original form in geometry when said main unit is liberated from the pressure;

a cap provided with a liquid agent discharging path for discharging a liquid agent and an air introducing path for introducing air, and attached to said main unit at said mouth;

a hydrophilic filter provided at a bottom surface of said cap;

an intermediate member having a tube projecting toward an interior of said main unit, said intermediate member being provided with a liquid agent introducing path provided internal to said tube and communicating with said liquid agent discharging path via said hydrophilic filter provided between said cap and said intermediate member, and an air supplying path communicating with said air introducing path, said intermediate member being located at an internal side of said cap, an outer peripheral surface of the tube being provided with an air vent groove extending along said liquid agent discharging path;

a filter; and an internal stopper having an annular valve configuring a check valve having an inner circumferential surface in contact with an outer circumferential surface of said tube and passing air only in a direction toward the interior of said main unit, said internal stopper being provided with an air delivering path communicating with said air supplying path via said filter and communicating with the interior of said main unit via said check valve, said internal stopper being located at an internal side of said intermediate member, wherein said filter is attached to a bottom surface of said intermediate member, such that a center of the filter is offset from a center of said intermediate member, and said filter is provided between said intermediate member and said internal stopper, and said internal stopper has an outer circumferential flange, and the outer circumferential flange of the internal stopper and an outer circumferential portion of the intermediate member are stacked and sandwiched between an end surface of the mouth of the main unit and the cap.

2. The liquid agent container according to claim 1, wherein said check valve removes a hermetically sealed state, in response to said main unit having an internal pressure lower than an atmospheric pressure with a difference of at least 5 KPa, to pass air proceeding through said air delivering path toward the interior of said main unit.

3. The liquid agent container according to claim 1, wherein said hydrophilic filter is provided between said liquid agent discharging path and said liquid agent introducing path and said filter provided between said air supplying path and said air delivering path is attached to said intermediate member.

4. The liquid agent container according to claim 1, wherein said filter provided between said air supplying path and said air delivering path is a hydrophobic filter.

5. The liquid agent container according to claim 1, wherein said end surface of said mouth of said main body is provided with a circular rib, and said circular rib digs into said internal stopper.

6. The liquid agent container according to claim 1, wherein said internal stopper has a first outer circumferential surface that extends in a vertical direction, and said intermediate member has a second outer circumferential surface that extends in the vertical direction forming a common surface with the first outer circumferential surface, and said cap has an inner circumferential surface extending in the vertical direction and directly opposing the common surface.

7. The liquid agent container according to claim 1, wherein said internal stopper is provided with a fit hole located coaxially with said check valve and receiving said tube to fit said tube therein.

8. The liquid agent container according to claim 7, wherein the air vent groove and an internal surface of said fit hole define the air delivering path.

* * * * *